United States Patent [19]

Lile

[11] 4,148,140

[45] Apr. 10, 1979

[54] FOLDING HUNTING KNIFE HAVING BALL LATCH

[76] Inventor: James B. Lile, Rte. 1, Russellville, Ark. 72801

[21] Appl. No.: 888,141

[22] Filed: Mar. 20, 1978

[51] Int. Cl.[2] ..... B26B 1/04

[52] U.S. Cl. ..... 30/161

[58] Field of Search ..... 30/160, 161, 159

[56] References Cited

U.S. PATENT DOCUMENTS

| | | | |
|---|---|---|---|
| 1,701,027 | 2/1929 | Brown | 30/159 |
| 2,304,601 | 12/1942 | Schrade | 30/159 |
| 3,930,309 | 1/1976 | Collins | 30/161 |
| 3,942,249 | 3/1976 | Poehlmann | 30/161 |

FOREIGN PATENT DOCUMENTS

| | | | |
|---|---|---|---|
| 549428 | 11/1942 | United Kingdom | 30/160 |

*Primary Examiner*—Jimmy C. Peters

[57] ABSTRACT

A hunting knife blade rotates by a pivot bore at one end thereof about a lock sleeve fixed within one end of a knife handle. Notches around the periphery of the pivot bore align with a radial passage through the lock sleeve when the blade is fully opened or fully closed and a sliding member within the lock sleeve has a depression on its outer surface axially alignable with the radial passage through the lock sleeve. A lock ball, of greater diameter than the sleeve thickness, is engaged in the radial passage, normally extending radially outward into a notch in the blade to lock it from angular rotation, but when said depression is aligned with said radial bore, to be cammed radially inward as the blade starts to rotate, to permit it to move to and lock in the outer position.

6 Claims, 4 Drawing Figures

FOLDING HUNTING KNIFE HAVING BALL LATCH

BACKGROUND OF THE INVENTION

The present invention relates to folding knives, particularly for use in hunting, and specifically to knives of the type in which the blade may be folded into a slot in the handle when not in use.

In the prior art, blades for folding knives have been rotatably supported on a pin or bushing through a support end of the knife blade. In such a knife, a leaf spring, contained in the back of the handle, is pressed outward by a cam on the blade support end as the blade is rotated. When the blade reaches the fully open position, the cam is "over center," holding the knife blade against rotation, and the spring returns to original position. Its end serves as a blade stop against further rotation in the opening sense; but the leaf spring offers only a small resistance to inadvertent closing. This resistance may be insufficient for use in hunting.

SUMMARY OF THE INVENTION

An object of the present invention is to provide a hunting knife having a blade which folds into the handle. Another object is to provide such a folding hunting knife for which the blade may be manually locked in one of several positions to reduce the risk of injury to the user. Still another object is to provide such a lockable folding hunting knife for which the locking mechanism is strong, yet compact. Further objects will be apparent from the following description.

Briefly summarizing, the present invention comprises a knife blade having a pivot bore at its end and a knife handle having a sleeve fixed at one end about which the blade rotates on its pivot bore. The pivot bore has a plurality of detent notches spaced around its periphery, alignable with a radial passage through the lock sleeve. A lock ball of greater diameter than the lock sleeve thickness is engaged in the radial passage. A sliding member extends within the lock sleeve, having an outer surface with a shallow depression in which the lock ball is engaged; this shallow depression holds the lock ball radially outward to engage a detent notch in the pivot bore of the blade, thus to lock the blade from rotation. The shallow depression in the outer surface of the sliding member tapers axially to a deepened depression, of sufficient thickness to permit the lock ball to move radially inward, entirely out of the detent notch, permitting the blade to rotate. A spring operates on the sliding member to so press it that the deepened depression tends toward non-alignment and the shallow depression toward alignment with the radial passage. Thus, when the blade is rotated so that a detent aligns with the radial passage, the spring pressure on the axially sliding member moves it so that the lock ball is pressed radially outward by the shallow depression to engage the detent. A button permits manual sliding of the sliding member to align its deepened depression with the radial passage, to again permit the blade to rotate.

DESCRIPTION OF THE PREFERRED EMBODIMENT

Figure 1:
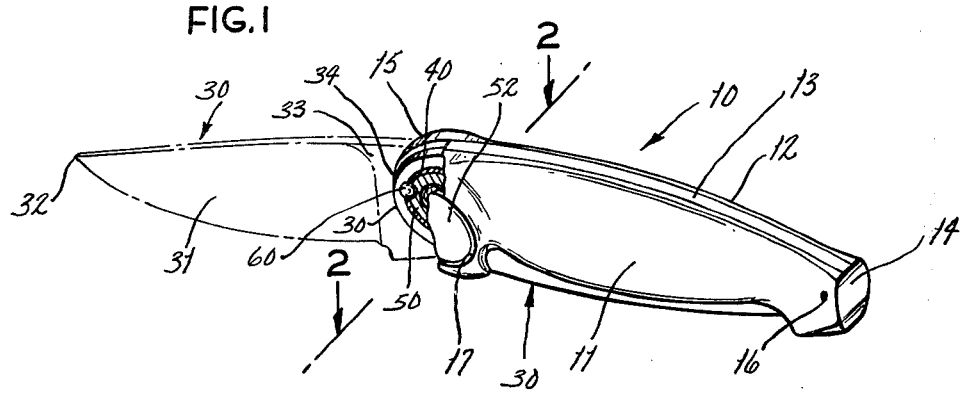
FIG. 1 is a perspective view of the present invention showing the blade in fully closed position in solid lines and in partially open position in phantom lines. The left scale is shown broken away to reveal the lock ball.

In the preferred embodiment of the present compact locking mechanism, a knife handle, generally designated 10, is formed of three parts: a left scale or frame part 11, a right scale or frame part 12, and a center frame part 13. Both the left and right scales 11, 12 are elongated stainless steel; the inner side of each scale is planar and the outer side is smoothly curved. The left and right scales 11, 12 are, in their general shape, mirror images of each other; the several differences between them are described below.

Figure 4:
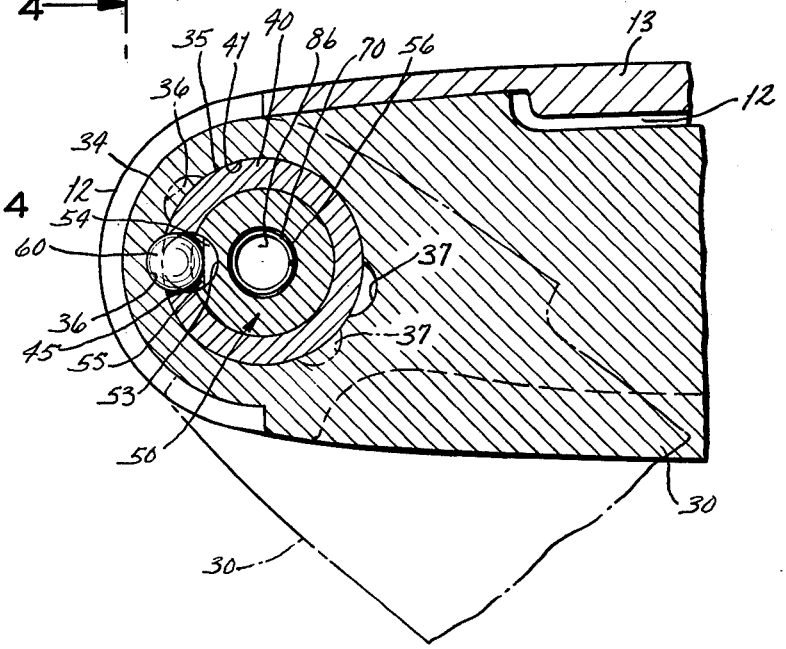
FIG. 4 is a sectional view of the present invention taken through the longitudinal center line of the blade. The solid line position of the blade shows it locked from rotation in fully closed position as in FIG. 2; phantom lines show the blade unlocked and rotated slightly from the closed position, as in FIG. 3.

When finally assembled, the planar surfaces of the left and right scales 11, 12 face each other and are secured together in a conventional manner with the center frame part 13 fixed therebetween along the back of the handle 10. For convenience this is referred to as the lower part of the handle; in this sense FIGS. 1 and 4 show the knife inverted. The center frame part extends upward only a small fraction of the depth of the left and right scales 11, 12, leaving a slot thereabove.

As shown in FIG. 1, the handle 10 generally extends from a pommel end 14, through which extends a thong eye 16, to a bolster end 15. At the bolster end 15 of the handle 10, through the left scale is a large retention bore 17. Along the inner planar surface of the right scale 12, the bore 17 has a radially outward-extending lip 18, of greater diameter than the diameter of the bore 17. Of the same diameter as the bore 17 in the left scale 11 is a bore 19 through the right scale 12, having a radially inward-extending lip 20 adjacent the planar inner surface of the right scale 12 of lesser diameter than the diameter of the bore 19.

When assembled, the lower edge of the handle 10 is a smooth combination of the three frame parts 11, 12, 13, giving the appearance of a one-piece handle, as shown in FIG. 1. The space between the left and right scales 11, 12 below the center frame part 13 forms a slot, seen in FIG. 4; the scales 11, 12 flank a knife blade, now to be described.

The knife blade, generally designated 30, is somewhat shorter than the knife handle 10, and has an elongated cutting portion 31 tapering to a pointed tip 32 at one end, and a thickened and widened planar support end portion 33 at its other end. This portion, which terminates in a cylindrical outer surface 34 at its extreme end, contains a relatively large diameter pivot bore 35, which has two detent notches 36, 37 extending radially outward along its periphery, their centers spaced angularly approximately 163° apart, as shown in FIG. 4. The first detent notch 36, located on the periphery of the pivot bore 35 opposite the cutting portion 31 of the blade 30, permits latching the blade 30 in the fully closed position. The second detent notch 37, angularly spaced 163° from the first detent notch 36 along the periphery of the pivot bore 35, is utilized for locking the blade 30 in the fully open position, as will be described below. The detent notches 36, 37 extend through the entire thickness of the support end portion 33 of the blade 30. Their perimetrical extent substantially equals the diameter of the lock ball, to be described below. The radial depth of the detent notches 36, 37 will likewise be described below.

Figure 2:
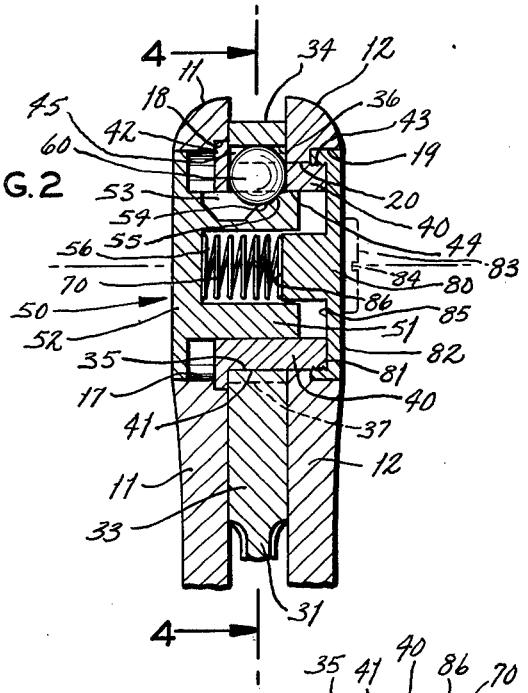
FIG. 2 is a sectional view taken along line 2—2 of FIG. 1, with the blade shown locked in its fully closed position. A tab with screw slot, which is ground off after assembly, is shown in phantom lines.
Figure 3:
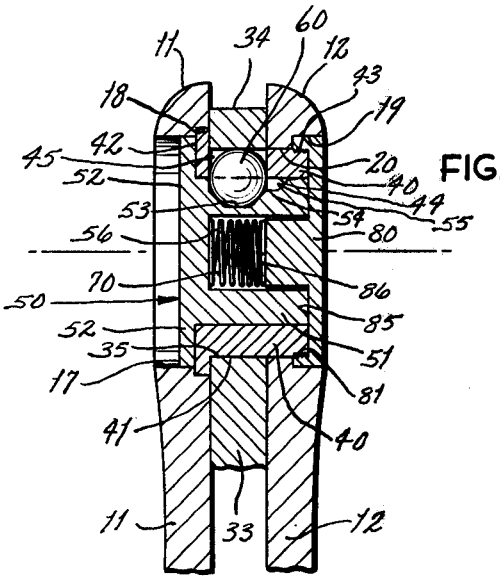
FIG. 3 is a sectional view taken along line 2—2 of FIG. 1, but with the sliding member depressed and the blade shown rotated from the closed position to a partially open position.

The blade 30 is supported by its pivot bore 35 on the bushing surface 41 of a lock sleeve, generally designated 40, which is tubular and generally cylindrical and has at one end a narrow flange 42 engaged within the radially outward extending lip 18 of the retention bore 17 in the left scale 11, as shown in FIGS. 2 and 3. At the end opposite the narrow flange 42, the lock sleeve 40 has external threads 43. Through the lock sleeve 40 extends an axial cylindrical hollow passage 44. In addition, the lock sleeve 40 has, extending therethrough, a radial latch passage 45 whose diameter is approximately that of the perimetrical extent of the detent notches 36, 37 along the periphery of the pivot bore 35, and slightly greater than the diameter of the lock ball, to be described below.

Extending within the cylindrical hollow passage 44 of the lock sleeve 40 is the generally cylindrical portion 51 of an inner sliding member, generally designated 50, having at one end a flanged button portion 52 of such greater diameter as to fit slidably within the retention bore 17 of the left scale 11 axially outward of the flange 42 of the lock sleeve 40. The outer surface of the cylindrical portion 51 of the sliding member 50 has a deepened depression portion 53 continuing axially into a shallower depression portion 54. This shallower depression portion 54 is closed by an end wall 55 at its end opposite the button portion 52; the cylindrical portion 51 continues at its full diameter. The shallower depression 54 and the deepened depression 53 are so located along the outer surface of the cylindrical portion 51 that the shallower depression 54 will be aligned with the radial passage 45 through the lock sleeve 40 when the outer surface face of the flanged button 52 is flush with the outer surface of the left scale 11. The flange of the button portion 52 is normally spaced from the narrow flange 42 of the lock sleeve 40, as seen in FIG. 2.

The inner end of the sliding member 50 has a hollow cylindrical cavity 56 extending inward axially to accommodate the compression spring, hereinafter described, which biases the lock button portion to such flush position.

A lock ball 60, like a ball bearing, of such size that the combined radial depth of the deepened depression 53 and the radial thickness of the lock sleeve 40 is at least equal to the ball diameter, is engaged in the radial passage 45 of the lock sleeve 40. The lock ball 60, which serves as movable latching means, projects radially from the radial passage in either of two positions. One is a locking, or radially outward, position shown in solid lines in FIG. 4; in this position the ball 60 projects both outwardly from the sleeve 40 into a detent notch 36, 37 and inwardly from the sleeve 40 into the shallower depression 54 of the sliding member 50. The other position is a retracted, or radially inward, position, in which the ball 60 projects only inward from the sleeve 40 into the deepened depression 33 of the sliding member 50; this permits the blade 30 to be rotated.

In keeping with the compact nature of the present invention, a compression spring 70 is provided within and projects axially from the hollow cylindrical cavity 56 of the sliding member 50.

A relatively flat large diameter cap nut 80 is provided, it being of sufficient size to be accommodated snugly within the bore 19 and against the inward lip 20 of the right scale 12. The cap nut 80 has inner threads 81 which screw onto the threads 43 on the end of the lock sleeve 40. The outer wall 82 of the cap nut 80 is originally provided with an axially outward-extending tab 83 having a screw slot 84, shown in phantom lines on FIG. 2. The inner wall 85 of the cap nut 80 has, extending axially inward within the inner tubular portion 55 of the sliding member 50, a spring seat block 86.

Assembly of the folding hunting knife proceeds as follows: first, the lock sleeve 40 may be spot welded or otherwise secured to the left scale 11 with its narrow flange 42 within the outward lip 18 of the retention bore 17, thereby preventing its rotation. Its radial passage 45 is shown adjacent to the furthermost point of the bolster end 15 of the handle 10; however, any other angular position of it and its mating parts will suffice. The cylindrical portion 51 of the sliding member 50 is inserted through the bore 17 of the left scale 11 into the cylindrical hollow passage 44 of the lock sleeve 40. The deepened depression 53 of the sliding member 50 is aligned with the radial passage 45 through the lock sleeve 40. Next, the lock ball 60 is inserted into the radial passage 45, projecting radially inward into the deepened depression 53, and the blade 30 is mounted on the lock sleeve 40. Then the center frame part 13 is put into position on the left scale 11 and the right scale 12 is placed thereon. These three frame parts 11, 12, 13 are fastened together by pins, not shown. Next, the compression spring 70 is placed inside the inner tubular portion 56 of the sliding member 50 through the bore 19 in the right scale 12 and the cap nut 80 is screwed onto the lock sleeve 40, leaving its outer wall 82 flush with the outer surface of the right scale 12. Last, the tab 83 on the outer wall 82 of the cap nut 80 is ground off and polished.

In operation of the present invention, the first detent notch 36 in the pivot bore 35 in the blade 30 aligns with the radial passage 45 through the lock sleeve 40 when the blade 30 is in the closed position, as shown in solid lines in FIG. 4. The second detent notch 37 is so aligned when the blade 30 is in the open position. When in either of those positions, the lock ball 60 is free to engage one of the detent notches 36, 37 in the pivot bore 35.

To rotate the blade 30, the lock button portion 52 is depressed against the compression spring 70, aligning the deepened depression 53 of the sliding member 50 with the radial passage 45 of the lock sleeve 40. On manual grasping of the knife blade 30 and applying torque to rotate it, the lock ball 60 is cammed radially inward by relative angular movement of the detent notches 36, 37 in the blade 30; and accommodated in the aligned deepened depression 53, as shown in FIG. 3. Then the blade 30 is free to rotate.

If the blade 30 is rotated to either the open or closed position, such that a detent notch 36, 37 in the pivot bore 35 aligns with the radial passage 45, the spring bias on the sliding member 50 tends to push it axially outward. The lock ball 60 is then pressed radially outward by the shallower depression 54, engaging the detent notch 36, 37, as shown in FIG. 2. The blade 30 is thus locked against rotation. The axially outward movement of the inner sliding member 50 is limited; the end wall 55 of the shallow depression 54 abuts the lock ball 60, preventing the spring 70 from pressing the inner sliding member 50 from within the cylindrical hollow passage 44 of the lock sleeve 40.

Modifications may be made if desired; for example, the knife blade may be locked in intermediate angular positions other than fully open or closed by providing a plurality of detent notches along the periphery of the pivot bore.

Other spring-biased means may be utilized to accommodate the lock ball in a radially inward position and alternately to press the ball radially outward in the latch passage. Also, the slidng member might be replaced by a rotating member having a shallow depression circumferentially continuing to an adjacent deepened depression, so that locking could be achieved by simple rotation of the rotating member by a thumbgrip on the lock button. Other manually depressible means to align a depression with the lock passage might be substituted.

Further, other radially movable latching means may be engaged within the radial latch passage 45. Preferably, such movable latching means may have a radially outward end which is rounded or, more generally, whose width measured angularly is reduced as it extends radially outward, thus providing a readily cammable surface. Thus when the blade 30 is rotated from its open or closed position, the detent notches 36, 37, being of sufficient size to accommodate the reduced-width outward end, by their angular movement cam and press the movable latching means radially inward.

Likewise, the lock sleeve may be secured against rotation by other means. For example, the retention bore 17 of the left scale 11 and flange 42 of the lock sleeve 40 may have splined surfaces which engage each other. Other modifications will from this disclosure be obvious to those skilled in the art.

The locking mechanism of the present invention may also be utilized to fold into protective cover elements such other blade-like elements as files, scissors, and keys, tools or other implements having relatively flat ends with pivot bores having detent notches, as herin described.

I claim:

1. A compact locking mechanism for latching a folding knife blade in one of a plurality of angular positions relative to a knife handle, comprising a knife blade, a pair of knife handle scales flanking said knife blade in closed position, one of said scales having a retention bore, a pivot bore in said knife blade, a plurality of radially outward-extending detent notches spaced angularly about the periphery of said pivot bore, a lock sleeve secured in said retention bore and having a tubular bushing portion rotatably supporting said knife blade by its said pivot bore, said lock sleeve further having therethrough a radially-extending passage, which upon rotation of said knife blade is alignable with each of said detent notches, said locking mechanism further having a hollow inner sliding member axially slidable within said tubular bushing portion of said lock sleeve, said inner sliding member having in its outer surface a depression including a deepened depression portion and a shallower depression portion continuing axially therefrom, said depression being aligned angularly and alignable axially with said radially-extending passage of said lock sleeve, and a lock ball engaged in said radially-extending passage of said lock sleeve and being of such diameter as (a) is not substantially less than the perimetrical extent of each of said notches, (b) when in said shallower depression projects radially beyond said passage into a said detent notch, and (c) when in said deepened depression portion, is completely retracted from said detent notch.

said inner sliding member having manually depressible means to align its said deepened depression portion with said radially-extending passage, whereby said lock ball, upon manual application of torque to said knife blade, is cammed radially inward into said deepened depression, thereby to permit said knife blade to be rotated to a selected one of said plurality of angular positions, and spring means within the hollow of said inner sliding member, to so bias said member axially as to bring its deepened depression portion out of alignment with said passage, whereby to engage said lock ball outward in one of said plurality of detent notches and lock said knife blade against angular rotation.

2. The compact locking mechanism as defined in claim 1, wherein said inner sliding member has, at that end of said shallower depression portion remote from said deepened depression portion, a full diameter portion, whereby the engagement of said ball in said shallower depression portion prevents movement of the said sliding member out of said lock sleeve.

3. A compact locking mechanism for latching a folding knife blade to prevent rotation relative to the knife handle, comprising a knife blade, a knife handle, a pivot bore in said knife blade, one or more detent notch means formed in said pivot bore and extending radially outward, a bushing means in said knife handle rotatably supporting said knife blade by its said pivot bore, a latch passage extending radially through said bushing means, movable latching means within said latch passage, and means alternately to accommodate said movable latching means in a radially inward position and to press said movable latching means radially outward in said latch passage.

whereby when one said detent notch means is aligned with said latch passage, said movable latching means may so partially radially outward as to engage said detent notch means, thereby locking said knife blade from rotation relative to said knife handle.

4. The locking mechanism as defined in claim 3, wherein said movable latching means has a rounded radially outward-extending end, and wherein said means to accommodate and to press said movable latching means radially outward is a manually-depressible, axially-slidable member and its said means to accommodate and press has an outer surface including a deepened depression portion.

whereby when said deepened depression portion is aligned with said latch passage, said movable latching means may retract radially inward from said detent notch means, thereby to permit rotation of such knife blade.

5. A locking mechanism for latching a folding blade-like element to prevent its rotation relative to a cover element therefor, comprising a cover element, a blade-like element, a piviot bore in said blade-like element, a bushing means secured in said cover element and rotatably supporting such blade-like element by its said pivot bore, a latch passage extending radially through said bushing means, and movable latching means within said latch passage, said latching means having an end whose width measured angularly is gradually reduced as it extends radially outward, whereby said end comprises a cammable surface, said blade-like element having notched detents formed in said pivot bore extending radially outward and of size sufficient to accommodate said end of said latching means, and means to press said movable latching means radially outward and to permit its retraction radially inward, whereby, when said means so permit such inward retraction, angular movement of said blade-like element causes said notch detent to cam said movable latching means radially inward, thereby freeing the blade-like element to rotate relative to the cover element.

6. The compact locking mechanism as defined in claim 5, wherein said movable latching means is a ball.

* * * * *

UNITED STATES PATENT AND TRADEMARK OFFICE

CERTIFICATE OF CORRECTION

PATENT NO. : 4,148,140

DATED : April 10, 1979

INVENTOR(S) : James B. Lile

It is certified that error appears in the above-identified patent and that said Letters Patent are hereby corrected as shown below:

In the Abstract, second last line, the word "outer" should be replaced with --other--.

In column 3, line 42, delete "face".

In column 5, line 40, replace "herin" with --herein--.

In Claim 1, line 5, after "depression" insert --portion--; in line 9, replace the period with a comma.

In Claim 3, line 50, replace the period with a comma; in line 53 after "partially", insert --extend--.

In Claim 4, line 65, replace the period with a comma.

Signed and Sealed this

*Thirty-first* Day of *July 1979*

[SEAL]

*Attest:*

*Attesting Officer*

LUTRELLE F. PARKER

*Acting Commissioner of Patents and Trademarks*